United States Patent [19]

Hannon et al.

[11] Patent Number: 5,007,554

[45] Date of Patent: Apr. 16, 1991

[54] CONTAINER LIFT TAB

[75] Inventors: Charles Hannon, 27 Sargent Rd., Scarsdale, N.Y. 10583; Leonard J. Vallender, Valhalla, N.Y.

[73] Assignee: Charles Hannon, Scarsdale, N.Y.

[21] Appl. No.: 343,046

[22] Filed: Apr. 25, 1989

[51] Int. Cl.[5] ..... B65D 41/32

[52] U.S. Cl. ..... 220/269; 220/270; 220/273

[58] Field of Search ..... 220/269, 270, 271, 273; 215/255

[56] References Cited

U.S. PATENT DOCUMENTS

| | | | |
|---|---|---|---|
| 3,501,046 | 3/1970 | Jasper et al. | 220/273 |
| 3,836,038 | 9/1974 | Cudzik | 220/269 |
| 3,977,561 | 8/1976 | Strobe et al. | 220/269 |
| 4,148,410 | 4/1979 | Brown | 220/269 |
| 4,210,257 | 7/1980 | Radtke | 220/273 |
| 4,416,389 | 11/1983 | Wilkinson et al. | 220/269 |
| 4,465,204 | 8/1984 | Kaminski et al. | 220/269 |
| 4,576,304 | 3/1986 | Henning | 220/269 |
| 4,762,245 | 8/1988 | Matsubayashi et al. | 220/269 |

*Primary Examiner*—David T. Fidei
*Attorney, Agent, or Firm*—Israel Nissenbaum

[57] ABSTRACT

A non-removable fulcrum-type lift tab, for opening a metal beverage container, is modified, by the inclusion of a lanced line at a position between the fulcrum pivoting line and the pushing end of the tab. The lanced line extends in a direction substantially perpendicular to the fulcrum-directed pushing force used to open the container, whereby, upon initial lifting of the tab, the lanced line opens, in a limited material separation. This results in substantially less lifting force (about 30% less), being needed to elevate the tab end about ¼ inch (about 6 mm) for a finger to be more easily inserted for completion of the opening of the container. At this stage, the ends of the lanced line, such as in the configuration of drilled holes or inwardly arcuate lanced sections, stop continued material separation by providing a high resistance to such separation. Additional lifting force is then operatively directed only on the container-opening fulcrum, with the limited material separation not significantly affecting the actual opening of the container. The arcuate lanced sections also direct possible continued tearing away from the peripheral edges of the tab and serve to relieve premature breakage from bending. To further ease initial finger purchase, the end of the tab which is lifted is formed with a partial elevation.

11 Claims, 4 Drawing Sheets

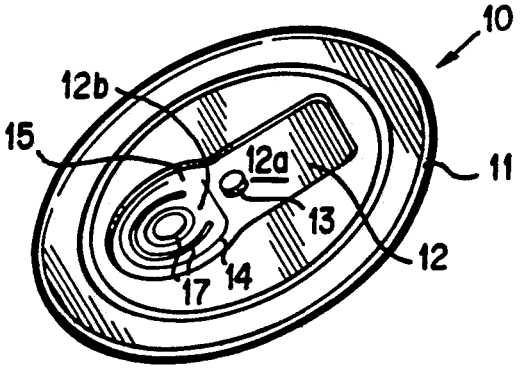
FIG. 1
PRIOR ART
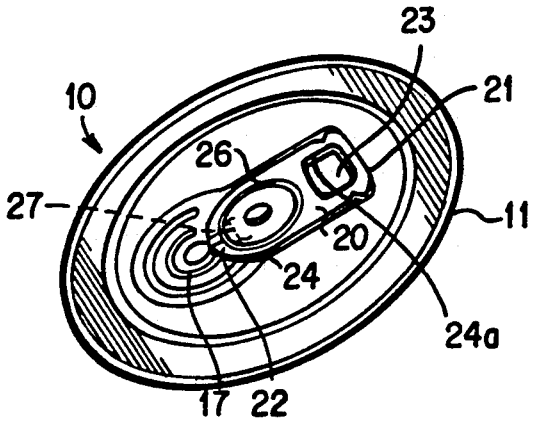
FIG. 2
PRIOR ART
FIG. 3
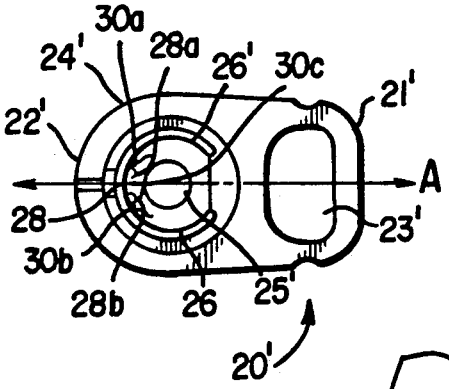
FIG. 3A
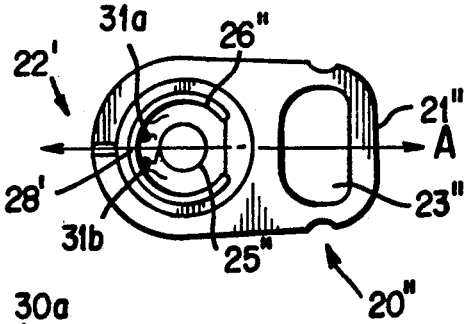
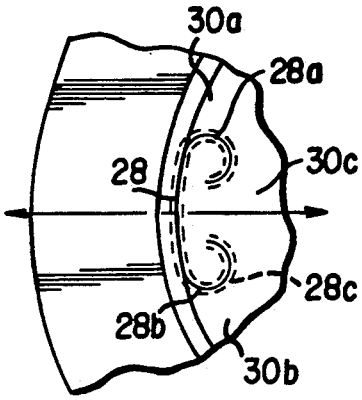
FIG. 4

CONTAINER LIFT TAB

BACKGROUND OF THE INVENTION

1. Field of the Invention:

This invention relates to opening tabs for metal beverage containers and particularly to non-removable fulcrum type lift tabs.

Beverage containers such as soda or beer cans are currently marketed with self contained openers in the form of lift tabs. In all of the present embodiments, the lift tab is comprised of a ring portion for control by an inserted finger. In one form of lift tab, the ring is attached to a pear shaped prescored section of the container top, with continued lifting of the ring causing the pear shaped section to become completely detached from the container top. This type of lift tab has however met with an environmental outcry since it has resulted in a new type of litter. Accordingly, a more acceptable non-detachable lift tab is presently being utilized on nearly all of the soda and beer cans currently sold in the United States, with the soda and beer cans being themselves recycled to reduce litter.

The non-detachable lift tab, with some design variations, is basically comprised of a short, somewhat rectangular, elongated aluminum strip (about $1\frac{1}{8} \times \frac{5}{8}$ inch $-28 \times 16$ mm) with rolled over edges for structural strength and for prevention of exposed sharp edges. At a first end, the tab is formed into a ring-like member (also with rolled over inner edges) for finger insertion and lifting. The second end, with strengthened rolled over edge, is rounded or tapered and centrally crimped for force-concentrated pushing engagement with a cantilevered weakened section of the container top, which will open upon continued application of force. To facilitate manufacture and container storage nesting, the usually circular container top is shallowly dished along a major portion of a diameter thereof. About half of the length of the dished area is formed for seated mating with the lift tab, i.e. slightly larger but conformed to the peripheral shape of the lifting end and adjacent sides of the lifting tab. The center of the container top, situated within the dished area, is formed with an outwardly extending hollow rivet-like section which fits into a corresponding aperture located on the longitudinal axis of the tab. The aperture is positioned on the tab such that the engagement between tab and container top results in about three quarters of the length of the tab (the lifting end) being situated on one side of the engagement site and about one quarter of the tab (the pushing end) being situated on the other side. The rivet-like section is then peened over, during assembly, to fixedly attach the lift tab to the container top.

The remaining dished area in the container top contains a weakening score line in the shape of a thumb nail (other design related shapes include truncated ovals or circles) having its tapered (or arced) end extending in a direction opposite that of the tab. A small portion of the "thumb nail", peripherally adjacent to the engagement site, however remains unscored. The pushing end of the tab extends over the non-scored portion and over the adjacent area enclosed by the thumb nail score line. During the opening operation, the lifting end of the tab is elevated. The tab pivots through the rivet engagement area and the pushing end of the tab swivels down thereby tearing and pushing the weakened area of the container top into the container. Because of its proximity to the pushing end of the tab, the scored area, adjacent the rivet-like section, tears open first, with initial internal gas pressure relief (the contained beverages are usually carbonated or are susceptible to internal gas evolution). Upon continued pushing force, the tear propagates around the score line away from the pushing end of the tab. The section of the container top, enclosed by the score line, then pivots down into the container in a cantilevered movement, and is held from falling into the container by the small unscored section of the "thumb nail". The area surrounding the contact point between the tab end and the container top is strengthened by a raised rib integrally formed within the "thumb nail" area to prevent gouging of the container top by the tab end.

In order to prevent detachment or breakage of the tab, at the peened over portion, the tab itself is partially circumferentially lanced or slotted around the engagement site. The lance line or slot extends from the lifting end of the tab to equidistant points just beyond the peened over engagement site and on both sides thereof. This partial circumferential lance line or slot also slightly overlaps the thumb nail score of the container top. The connecting line between the ends of this lance line or slot defines the pivoting or fulcrum line (slightly removed from the peened over rivet section) for the pushing end of the tab and all the pivoting or fulcrum force is concentrated on this pivoting line. Initial lifting of the tab through the pivoting line is relatively strongly resisted by engagement of the pushing end of the tab with the container top and the force required to open the score line in the container top. Such resistance is even greater if the contents of the container are also pressurized. This relatively high resistance results in significant consumer inconvenience particularly since the lifting end of the tab is near the obstructing raised edge of the seal between the container top and the container. In addition, access to the tab is further obstructed by the tab being slightly lowered into the dished area of the container top. Insertion of a finger for lifting the tab is impeded and the small purchase area initially available coupled with the relatively high opening resistance results in the very real likelihood of fingernail breakage. Such resistance is, of course, negligible if the full finger and not just a fingernail can be utilized for lifting. In order to obviate this problem some lift tabs are provided with an elevated ring tab. However, the degree of elevation is limited by increased difficulty in manufacturability and the fact that the containers are to be stacked for storage. Thus, an overly elevated tab will either be bent or will impede proper stacking and such elevation cannot be more than about $\frac{1}{8}$ of an inch (3 mm) whereas about $\frac{1}{4}$ inch (6 mm) is required for effective fingerpurchase on the lifting end of the tab. Other means for providing the initial lift for full finger purchase include the use of special flat lifting tools which are small enough to be inserted under the tab and then used as small levers in place of breakable fingernails.

It is noted that the previously used detachable (but environmentally objectionable) tab offered little or no resistance pressure to moving the tab into a perpendicular position, for full finger grasp, prior to the lifting off opening.

SUMMARY OF THE INVENTION

It is an object of the present invention to provide a means, integral with the container, for facilitating opening of a container having a non-detachable fulcrum type lift tab.

It is a further object of the present invention to provide such means by economically modifying the tab structure to reduce the applied force required to lift the tab to a desired height sufficient for full finger purchase, without affecting tab opening reliability.

It is a still further object of the present invention whereby modification of the tab structure requires minimal modification of existing container production machinery and facilities.

These and other objects, features and advantages of the present invention will become more evident from the following discussion as well as the drawings in which:

BRIEF DESCRIPTION OF THE DRAWINGS

FIG. 1 is an isometric view of a typical container top prior to emplacement of a non-detachable fulcrum type lift tab;

FIG. 2 is an isometric top view of a prior art lift tab attached to the container top of FIG. 1 (since placement and general configuration of the lift tab of the present invention is identical to that of the prior art, FIG. 2 is accordingly representative of the placement and general configuration of the tab of the present invention attached to the container top of FIG. 1);

FIG. 3 is a top view of an embodiment of the lift tab of the present invention;

FIG. 3A is a top view of a second embodiment of the lift tab of the present invention;

FIG. 4 is an enlarged view of area A of FIG. 3;

FIG. 5 is representative of both the prior art and present invention tabs in the initial state;

FIG. 6 is representative of a tab of the prior art being elevated to a point at which the container begins to open;

FIG. 7 is representative of a tab of the present invention being elevated to a point at which the container begins to open;

FIG. 8 is representative of both the prior art and present invention tabs during the actual opening of the container;

DETAILED DESCRIPTION OF THE INVENTION AND PREFERRED EMBODIMENTS

Figure 5:
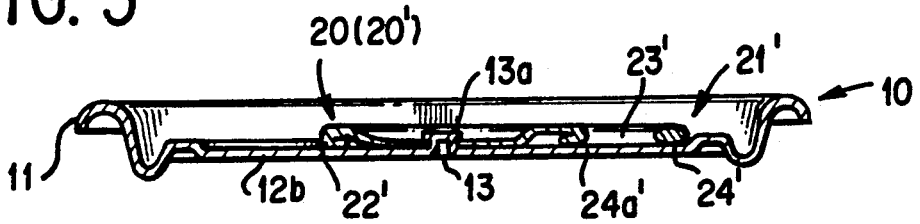
(FIGS. 5–8 are sequential sectioned side views showing the opening stages of a container using a tab of the prior art and a tab of the present invention.)

Generally the present invention comprises an improved non-detachable fulcrum type lifting tab, for opening a container. The tab embodies integral means, for reducing the amount of force required for lifting the tab from the container top to an elevation sufficient for a finger to be readily inserted for continued lifting and opening of the container. The integral means serve to delay the initiation of the opening of the container, and its attendant high resistance, until the tab has reached the more conveniently accessible elevated position.

As described above, non-detachable fulcrum type lifting tabs have a first end for finger lifting, and a second end for pushing engagement with a scored and weakened section of the container top, with the container top being opened thereby. The tab is apertured for attachment to the container top by engagement with a rivet like section of the container top which is peened down to fixedly hold the tab in place. Elevation of the lifting end of the tab causes the tab to swivel through a pivot line, adjacent the engagement point, for opening of the weakened section of the container top (in accordance with the configuration and operation described above). However, the residual metal in the score of the container top, particularly if buttressed with pressurized container contents, relatively strongly resists the initial lifting of the tab and provides an impedance for full finger insertion under the lifting end of the tab.

In accordance with the present invention, an increased slack or degree of compliance is introduced with a limited secondary fulcrum area being established between the tab pivot line and the second or pushing end of the tab. This increased slack or compliance allows the lifting tab to attain a higher elevation before the actual initiation of the opening of the container. Operation of this secondary fulcrum accordingly results in a low resistance, minimal distortion, of the tab itself during the initial tab lifting, prior to opening of the container and its attendant higher resistance. Because of the lower force required to distort the tab and its position of greater mechanical advantage (i.e. closer to the pushing end of the tab than the main pivot line), the secondary fulcrum will preferentially operate first, until the lifting end of the tab has reached a desired height, preferably about ¼ inch (6 mm), suitable for full finger insertion under the lifting end of the tab. Continued operation of the secondary fulcrum, after the lifting end of the tab has reached the desired height, would normally detrimentally result in the tab being detached from the container without proper opening of the container. Accordingly, the tab is also provided with limiting means to stop the continued operation of the secondary fulcrum. The fulcrum limiting means becomes operable, when the tab has reached the desired lifting height, by increasing the force necessary for continued operation of the secondary fulcrum in excess of that required for operation of the main container-opening fulcrum action. As a result, continued lifting of the tab will thereafter concentrate force on the main fulcrum pivot area, for opening of the container, with the secondary fulcrum being effectively bypassed from any additional operation.

In an embodiment of the present invention, the lifting tab is modified by the inclusion of a lanced line, with integral inwardly curled or arcuate segment ends, at a position between the fulcrum pivoting line and the pushing end of the tab and preferably directly adjacent the rolled over metal portion of the second or pushing end of the tab. The lanced line extends in a direction substantially perpendicular to the fulcrum directed pushing force and is spaced from the main fulcrum or pivot line by a small amount of residual metal. This residual metal functions as the pivot area of a secondary fulcrum which causes separation or opening of the lanced line during initial lifting of the tab. In effect, the opening of the lanced line diverts force directed towards the main fulcrum and translates such force into a lanced line opening force which requires a lesser force, during the initial lifting of the tab end, to the same height. It is preferred that the lanced line be symmetrical on either side of the longitudinal axis of the tab to avoid skewing during lifting of the tab by evenly distributing forces over the entire secondary fulcrum pivoting area. The inwardly curled or arcuate ends function to limit the extent of the secondary fulcrum movement by providing increased resistance to continued opening of the lanced line after the initial lifting of the tab. Such resistance is above that required for operation of the main fulcrum which will then preferentially operate to open the container as described above.

In operation, the lifting end of the tab swivels upwardly, with the lanced line opening in a limited manner during the initial lifting of the tab. Substantially reduced lifting force is required to elevate the tab end about ¼ inch (about 6 mm) which is sufficient for a finger to be more easily inserted for completion of the fulcrum opening of the container. At this elevational height, continued opening of the lanced line ceases and the limited opening of the lanced section does not significantly affect the actual opening of the container thereafter.

Examples of other fulcrum limiting ends also include drilled holes at each end of the lanced section. The curled or arcuate ends are preferred since they serve, in addition, to direct continued possible tearing away from the peripheral edges of the tab and relieve premature breakage from bending.

In another embodiment of the present invention, a very narrow slot, with ends resistant to tearing, may be utilized in place of the lanced line (with fulcrum and tear limiting ends), for similar relief of initial tab lifting resistance. Too much material should not however be removed with the formation of the slot since it would tend to overly weaken the secondary fulcrum area of the tab. It is also preferred, in order to further ease initial finger purchase, that the end of the tab, which is lifted, be formed with a partial elevation.

The secondary fulcrum lance line or slot preferably falls on the circumference of the circle which is initially defined by the partial circumferential lance or slot of the tab (utilized to move the fulcrum position away from the peened over rivet). The secondary fulcrum lance line or slot must however be spaced on both sides from the partial circumferential lance or slot, whereby sufficient metal remains to function as the secondary fulcrum pivot with sufficient strength to hold the lifting tab to the container top for at least two back and forth cycles of the tab.

Since the present invention requires only the formation of a lance line or a slot, only slight modification is required in the tab stamping die in order to utilize existing container production machinery and facilities in manufacturing the modified tabs and attaching them to unmodified container tops.

Figure 8:
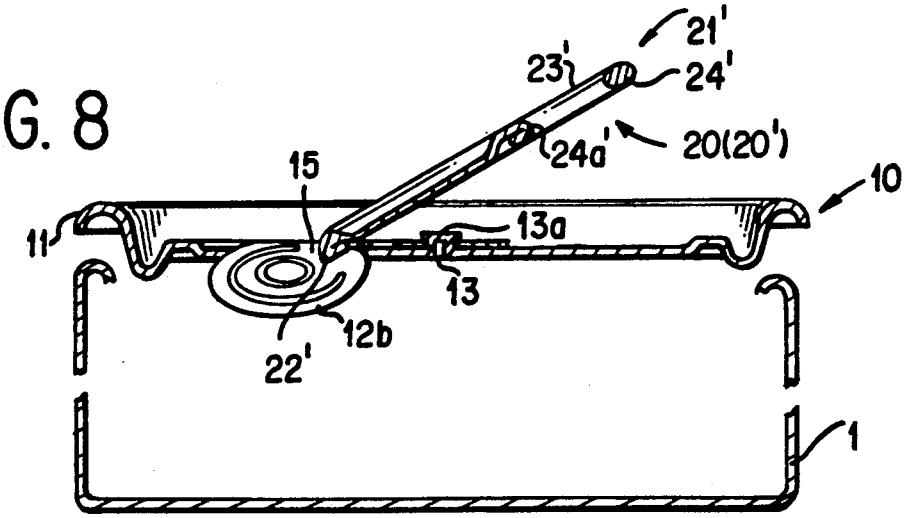

With specific reference to the drawings, wherein like parts have the same reference numbers, circular container top 10, shown in FIG. 1 prior to attachment of a lifting tab, is originally die stamped from an aluminum disk, with a rolled-over circumferential edge 11 for crimped engagement with a container. During such die stamping, the container top 10 is modified with an integral opening mechanism. Dished section 12 is shaped for seating of an opening tab 20 as shown in FIG. 2 in portion 12*a* thereof. Dished section 12 is further shaped with centrally raised hollow rivet-like section 13 for engagement with the opening tab element 20. Portion 12*b* of dished section 20 is deformed with raised strengthening ribs 17 and weakened by thumb nail shaped score line 14 having an unscored section 15 peripherally adjacent rivet 13. As shown in FIG. 8, the area of portion 12*b*, circumscribed by thumb nail score line 14, is pushed into the container 1 during the opening process and is prevented from complete separation from the container top 10 by the residual unscored section 15.

Figure 9:
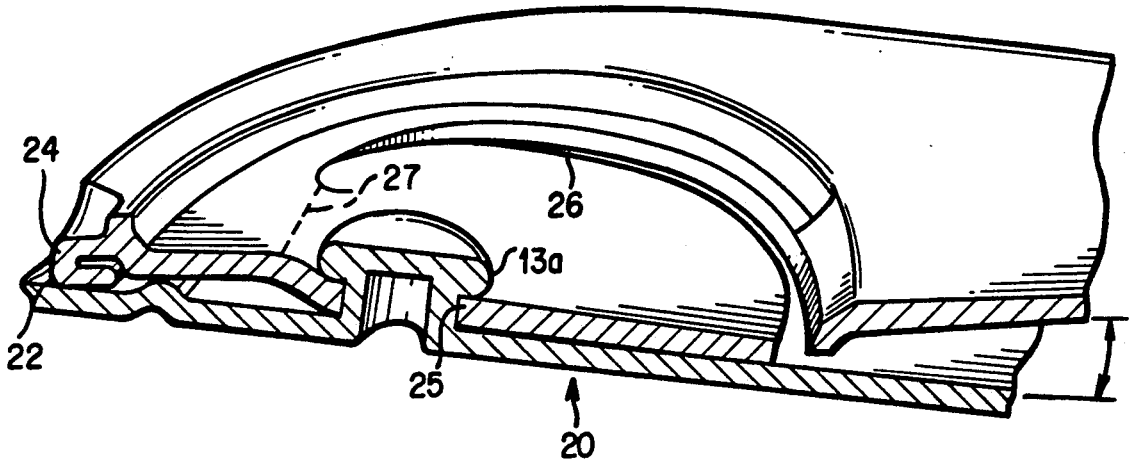
FIG. 9 PRIOR ART
FIG. 9 is a sectioned isometric expanded view of the pushing end of the prior art tab shown in FIG. 6.
Figure 10:
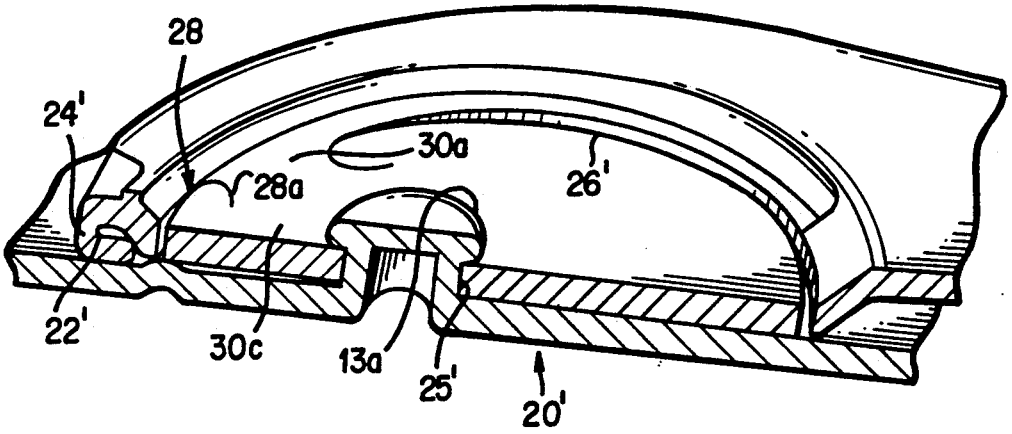
FIG. 10 is a sectioned isometric expanded view of the pushing end of the tab of the present invention when in the position shown in FIG. 5.
Figure 11:
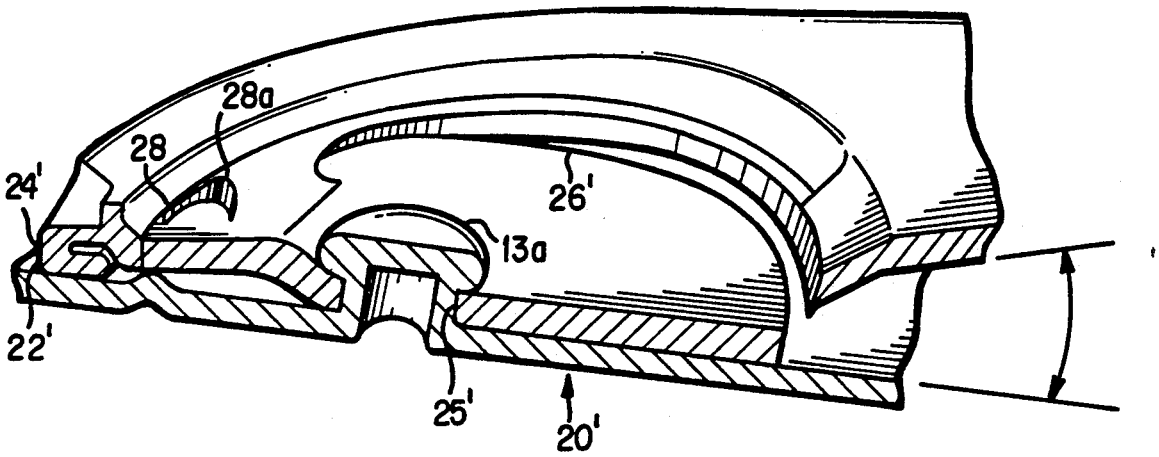
FIG. 11 is a sectioned isometric expanded view of the pushing end of the tab of the present invention shown in FIG. 7.

As shown in FIG. 2 and more clearly in FIGS. 9–11, opening tab element 20 or 20' is affixed to the completed container top 10 by insertion of rivet-like section 13 of the container top into aperture 25 or 25' of the tab. Rivet 13 is then peened into peripherally overlapping edge 13*a* to lock the container top 10 and tab element 20 or 20' together. The container top 10, with affixed tab element 20 or 20', is then secured, by circumferential crimping, as schematically depicted in FIG. 8, to container 1 which has been filled with a beverage.

Tab element 20 is separately die stamped from a somewhat rectangular strip of aluminum. During this die stamping the outer edge of the aluminum strip is rolled over to form strengthened peripheral edge 24. Ring 23 is stamped out for accommodation of an inserted finger with rolled over inner edge 24*a* for strength and to prevent cuts. After tab 20 is securely engaged with container top 10, it becomes a lever with respect to the container. Tab element end 21, with finger accommodating ring 23, is the end which is lifted and tab element end 22, with a force concentrating rounded edge, serves as the pushing end for opening of container 1. Partial circumferential lanced line 26 extends from a location adjacent ring 23 and terminates slightly beyond the engagement point of tab element 20 and container top 10 on either side thereof. During the opening of the container 1, having a prior art lift tab, as sequentially shown in FIGS. 5, 6 and 8, the tab element 20 or 20' (shown in the original position in FIG. 5) is elevated slightly by the insertion of a finger tip, or thin flat tool to the position shown in FIG. 6 and in clearer detail in FIG. 9, prior to initiation of the container opening with the breaking of score line 14. Partial circumferential lanced line 26 permits the elevation without stressing edge 13*a*, which secures the tab to the container top. The container opening process shown in FIGS. 5, 6 and 8 involves the tab element 20 or 20' functioning as a lever in a fulcrum type action with the fulcrum or pivot line extending between the ends of partial circumferential lanced line 26 or 26' (shown as dotted fulcrum line 27 in FIG. 2).

Figure 6:
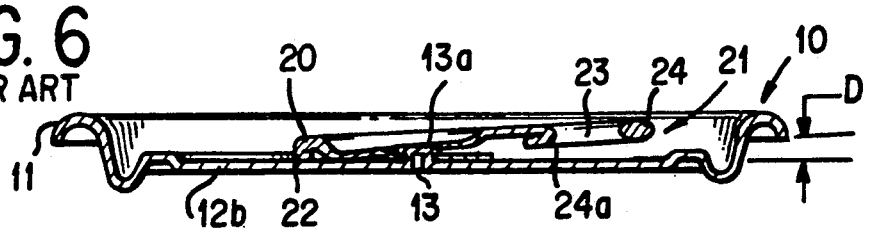
FIG. 6 PRIOR ART
Figure 7:
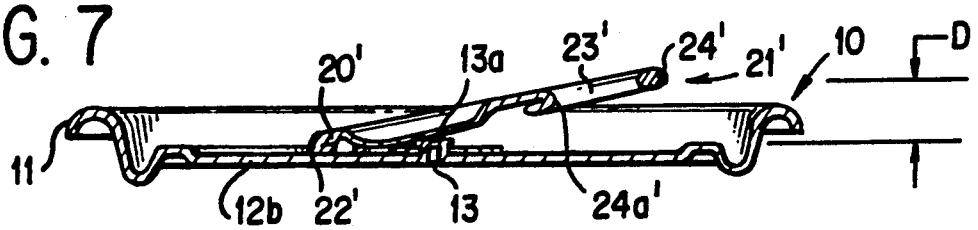

At the initial minimal elevation D (shown in FIG. 6), insufficient for the insertion of a finger beneath the tab, the area between pivot line 27 and tab pushing end 22 is relatively stiff without compliance. Accordingly, high resistance is encountered by the pressing engagement between pushing end 22 and the "thumb nail" circumscribed area 14 of the container top. This resistance is of a magnitude requiring the inclusion of strengthening rib 17 to prevent the pushing end 22 from gouging the metal of the container top prior to opening of the score line 14. Only after this resistance is overcome (at times with accompanying fingernail breakage), with initial breaking of score line 14, can tab end 21 be elevated to the position such as shown in FIG. 7 (generally at a height from the container top of about ¼") wherein a finger can be more readily or fully inserted beneath the tab for continued elevation of the tab and completion of the opening of the container as shown in FIG. 8.

The tab 20' of the present invention, as shown in FIG. 3 and more clearly in FIGS. 4, 10 and 11, is identical to the tab of the prior art, shown in FIGS. 2 and 9, except for the lancing of the tab, with lance line 28, directly adjacent the folded over edge 24' of the pushing end 22'. Lance line 28, terminates in arcuate lanced ends 28*a* and 28*b*, and is on the circumference of the partial circle of lanced line 26'. Lance line 28 perpendicularly straddles longitudinal axis A of the tab which also defines the direction of exertion of the fulcrum force during opening of the container. Narrow slot 28*c*, shown with dashed lines, is similarly operable, as described above. As shown in FIGS. 5, 7 and 8, the container is opened in a fashion identical to that of the prior art shown in FIGS. 5, 6 and 8, except that in reaching the stage shown in FIG. 7, lance line 28 has opened slightly by the fulcrum directed force along axis A. Lifting forces exerted against the resistance offered by the scored container top, are thereby diverted to act on residual unlanced areas 30*a* and 30*b* and 30*c*. This causes such unlanced areas to function as pivot points for the secondary fulcrum opening of the lance line 28, with greater slack or compliance of the metal at such points, thereby permitting the increased elevation prior to initiation of the opening of score line 14, with its concomitant high resistance. Once lance line 28 is opened, as more clearly shown in FIG. 11, the lifting end of the tab has been elevated to the requisite height D' for full finger insertion. Further force thereafter encounters the inwardly directed arcuate ends 28*a* and 28*b* which offer a substantially increased resistance. The terminating apertures 31*a* and 31*b* shown in the alternative tab embodiment of FIG. 3A, provide a similar increased resistance function. Continued lifting forces are thus redirected to the main pivot line 27 and the container is opened, in a fashion identical to that of the prior art as shown in shown in FIG. 8.

In order to more clearly illustrate the effectiveness of the present invention, the following comparative examples are presented. It is understood that details contained in such examples are for illustrative purposes only and are not to be construed as limitations on the present invention.

COMPARATIVE EXAMPLE 1

Two lift tabs are attached to identical beverage container tops with identical peened over rivet attachments. One of the lift tabs has the lance line of the present invention positioned directly adjacent the rolled over pushing end of the tab and symmetrically perpendicular to the longitudinal axis of the tab. The lance line is about 0.09 inch in total length (2.3 mm) with symmetrical ¾ circle arcuate ends each having an 0.02 inch (0.5 mm) diameter. A hook attached to a hand held spring scale is used to lift the ring end of the tabs to an elevation of ¼ inch (6 mm. The unmodified or prior art tab requires a lifting force of 1.4 pounds whereas the modified tab of the present invention requires a lifting force of 1.0 pounds to the same height. Continued opening of the containers thereafter is identical in operation, and, as required by some beverage companies, only after three back and forth motion of both tabs through the fulcrum area do the tabs break off.

COMPARATIVE EXAMPLE 2

Two containers with lift tabs as in Example 1 are similarly tested with the application of identical lifting forces of two pounds. The prior art lift tab is elevated to a height of 0.3 inch. The lift tab made with the lance line of the present invention is elevated to a height of 0.4 inch with the application of the same lifting force.

It is understood that the above examples are for illustrative purposes and that details contained therein are merely illustrative of the efficacy of the present invention and are not limitations of the present invention. Other modifications of the container top and tab such as varying configurations, dimensions and locations of the fulcrum force relief means as well as container top and tab materials are possible without departing from the scope of the present invention as defined in the following claims.

What is claimed is:

1. A lift tab, for fulcrum opening of a top of metal container, comprising an elongated metal member having means for fixed engagement of a portion of the tab to the metal container top; wherein with said tab being fixedly engaged to said container top, said tab comprises first and second ends located on opposite sides of the fixed engagement portion, with the second end adapted to partially overlap a weakened section of the container top, and said tab further comprising a fulcrum pivoting area between the fixed engagement portion and the second end, whereby elevation of the first end causes the tab to swivel through the pivoting area with the second end being forced into pushing engagement with the weakened section of the container top thereby causing the weakened section to tear open, characterized in that the tab further comprises means to permit increased elevation of the first end of the tab to a pre-determined height without concomitant increase in lifting force, said means comprising a secondary fulcrum operably positioned between the fulcrum pivoting area and the second end, with said secondary fulcrum intersecting a longitudinal axis between said first end and said second end, and which longitudinal axis passes through the position at which said tab is fixedly engaged to said container top, wherein the secondary fulcrum initially operates until the pre-determined height is reached and whereby the tab further includes secondary fulcrum limiting means which limits further operation of the fulcrum pivoting area for causing the tearing open of the weakened section of the container top, wherein the means to permit increased elevation comprises a lanced line positioned between the fulcrum pivoting area and the second end, with the lanced line intersecting said longitudinal axis.

2. The lift tab of claim 1 wherein the means to permit increased elevation comprises a lanced line positioned between the fulcrum pivoting area and the second end, with the lanced line intersecting said longitudinal axis, and wherein material of the tab, between the lanced line and the fulcrum pivoting area, functions as the pivoting area for the secondary fulcrum with the opening of the lanced line.

3. The lift tab of claim 2 wherein the secondary fulcrum limiting means comprises two lanced segments, integrated with each of the ends of the lanced line, and wherein each of the lanced segments is inwardly curled towards the longitudinal axis.

4. A lift tab, for fulcrum opening of a top of a metal container, comprising an elongated metal member having means for fixed engagement of a portion of the tab to the metal container top; wherein when said tab is fixedly engaged to said container top, said tab comprises first and second ends located on opposite sides of the fixed engagement portion, with the second end adapted to partially overlap a weakened section of the container top, and said tab further comprising a fulcrum pivoting area between the fixed engagement portion and the second end, whereby elevation of the first end causes the tab to swivel through the pivoting area, with the second end being forced into pushing engagement with the weakened section of the container top, thereby causing the weakened section to tear open, characterized in that the tab further comprises means to permit increased elevation of the first end of the tab, to a pre-determined height, without concomitant increase in lifting force, wherein said means to permit increased elevation comprises a secondary fulcrum operably positioned between the fulcrum pivoting area and the second end, wherein the secondary fulcrum initially operates, until the pre-determined height is reached and whereby the tab further includes secondary fulcrum limiting means which limits further operation of the secondary fulcrum, at the pre-determined height, with the subsequent operation of the fulcrum pivoting area for causing the tearing open of the weakened section of the container top, wherein the means to permit increased elevation comprises a lanced line positioned between the fulcrum pivoting area and the second end, with the lanced line intersecting to a longitudinal axis, between the first and second ends, which passes through the fixed engagement portion and wherein material of the tab, between the lanced line and the fulcrum pivoting area, functions as the pivoting area for the secondary fulcrum with the opening of the lanced line, and wherein the secondary fulcrum limiting means comprises cleanly drilled apertures at the ends of the lanced line.

5. The lift tab of claim 1 wherein the lanced line, which comprises the means to permit increased elevation, comprises a slot positioned between the fulcrum pivoting area and the second end, with the slot intersecting the longitudinal axis.

6. The lift tab of claim 5 wherein the means to permit increased elevation comprises a slot positioned between the fulcrum pivoting area and the second end, with the slot intersecting the longitudinal axis, and whereby material of the tab, between the slot and the fulcrum pivoting area, functions as the pivoting area for the secondary fulcrum with the increased separation of the sides of the slot.

7. A container having the lift tab of claim 1 fixedly engaged thereto.

8. A container having the lift tab of claim 3 fixedly engaged thereto.

9. A method for reducing the amount of pressure required for elevating a lift tab, for fulcrum opening of a top of a metal container, comprising an elongated metal member having means for fixed engagement of a portion of the tab to the metal container top; wherein with said tab being fixedly engaged to said container top, said tab comprises first and second ends located on opposite sides of the fixed engagement portion, with the second end adapted to partially overlap a weakened section of the container top, and said tab further comprising a fulcrum pivoting area between the fixed engagement portion and the second end, whereby elevation of the first end causes the tab to swivel through the pivoting area with the second end being forced into pushing engagement with the weakened section of the container top thereby causing the weakened section to tear open, characterized in that said method comprises operably positioning a secondary fulcrum between the fulcrum pivoting area and the second end, wherein the secondary fulcrum initially operates until a pre-determined height is reached and wherein further operation of the secondary fulcrum at a pre-determined height is limited with the subsequent operation of the fulcrum pivoting area for causing the tearing open of the weakened section of the container top, and wherein the secondary fulcrum comprises a lanced line positioned between the fulcrum pivoting area and the second end, with the lanced line intersecting a longitudinal axis between the first and second ends which passes through the fixed engagement portion and wherein material of the tab, between the lanced line and the fulcrum pivoting area, functions as the pivoting area for the secondary fulcrum with the opening of the lanced line.

10. The method of claim 9 wherein the secondary fulcrum is limited from continued operation at the pre-determined height by two lanced segments, integrated with each of the ends of the lanced line, and which lanced segments are inwardly curled towards the longitudinal axis.

11. A lift tab, for fulcrum opening of a top of a metal container, comprising an elongated metal member having means for fixed engagement of a portion of the tab to the metal container top; wherein with said tab being fixedly engaged to said container top, said tab comprises first and second ends located on opposite sides of the fixed engagement portion, with the second end adapted to partially overlap a weakened section of the container top, and said tab further comprising a fulcrum pivoting area between the fixed engagement portion and the second end, whereby elevation of the first end causes the tab to swivel through the pivoting area with the second end being forced into pushing engagement with the weakened section of the container top thereby causing the weakened section to tear open, characterized in that the tab further comprises means to permit increased elevation of the first end of the tab to a pre-determined height without concomitant increase in lifting force, said means comprising a lanced line positioned between the fulcrum pivoting area and the second end, with the lanced line intersecting a longitudinal axis between the first and second ends which passes through the fixed engagement portion and wherein a lanced segment is integrated with each of the ends of the lanced line, and which the lanced segments are each inwardly curled towards the longitudinal axis.

* * * * *